United States Patent [19]

Boyer et al.

[11] 4,184,273

[45] Jan. 22, 1980

[54] BOOT WITH HINGED UPPER

[75] Inventors: Scott M. Boyer; Chris R. Dawson; Charles S. French; Clyde R. Morgan; Fred F. Grabos, Jr., all of Ketchum, Id.

[73] Assignee: Scott USA, Inc., Sun Valley, Id.

[21] Appl. No.: 831,084

[22] Filed: Sep. 6, 1977

[51] Int. Cl.[2] ..... A43B 5/04

[52] U.S. Cl. ..... 36/131; 36/117

[58] Field of Search ..... 36/117, 118, 119, 120, 36/121, 50, 131, 30 R, 109

[56] References Cited

U.S. PATENT DOCUMENTS

| | | | |
|---|---|---|---|
| 3,803,730 | 4/1974 | Hanson et al. | 36/117 |
| 3,807,061 | 4/1974 | Krus et al. | 36/30 R X |
| 3,811,207 | 5/1974 | Peis | 36/117 |
| 3,906,645 | 9/1975 | Heckel | 36/131 |
| 3,945,134 | 3/1976 | Ramer | 36/121 |
| 4,062,133 | 12/1977 | McGee et al. | 36/131 |

*Primary Examiner*—Patrick D. Lawson

*Attorney, Agent, or Firm*—Wegner, Stellman, McCord, Wiles & Wood

[57] ABSTRACT

A motorcycle boot includes a lower vamp shell having a front tongue and rear tapering flaps which extend into an upper shell assembly formed by a hinged front door and a rear cuff. The door, of impact resistant plastic to protect the wearer's shin, interleaves with the cuff and is closed by overlying flexible straps. A closure system includes wire bales, longitudinally adjustable within holes spaced along the straps, and received with toothed latched receivers. The side legs of each wire bale snap-fits under locking flanges when the bale is closed over center. A connector hinge assembly includes a slotted plate, attached to the vamp shell, through which extends a freely movable pivot pin journalled in the upper shell to allow forward and rearward motion, rockable sideways motion, and lateral twisting of the shells. A replaceable sole insert, formed by a resilient pad molded to a carrier plate, is mechanically locked within a base recess on the bottom of the shell. An inner liner extends through the upper shell and is sealed to the lower vamp. A replaceable bootie extends into the vamp shell and is fastened to the inner liner.

32 Claims, 22 Drawing Figures

30
58
86
80
84
88
82
56
152
150
38
156
168
166
164
160
42
162
154
40
170
120
122
34
190
184
124
187
180
35
32
36
65
64
62
60
100
94
108
66
68
54
106
52
262
260
96
50
112
110
202
8.

152
60
108
150
38
50
166
168
164
122
160
124
156
32
170
58
9.
80
82
120
112
110
142
154
35
42
132
36
140
144

Fig. 10.
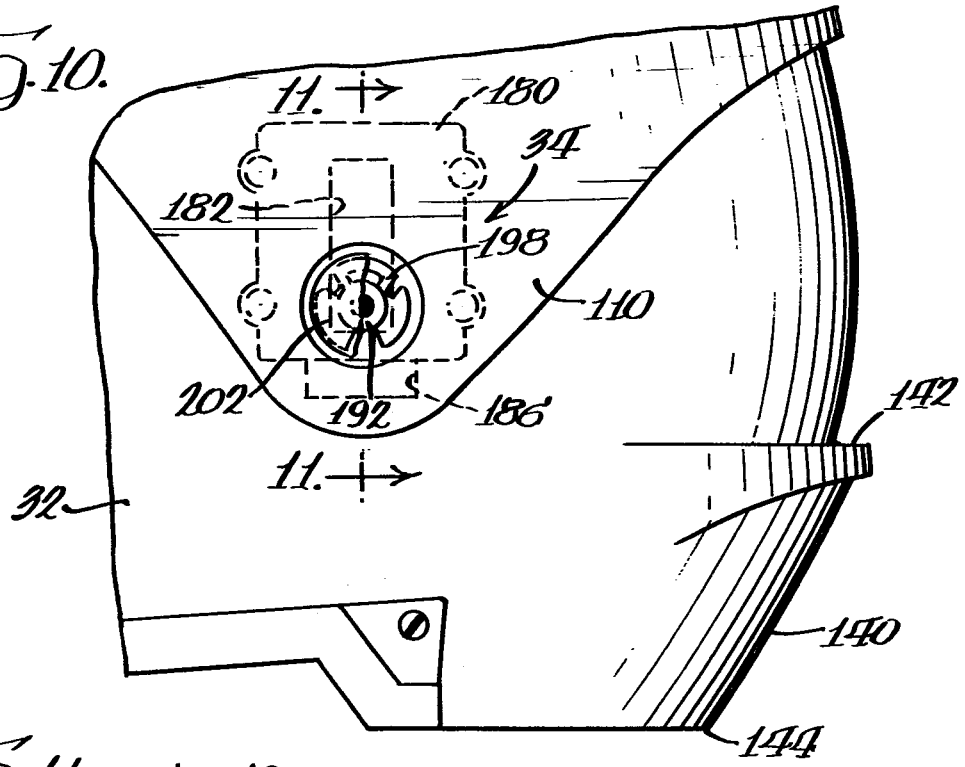
Fig. 11.
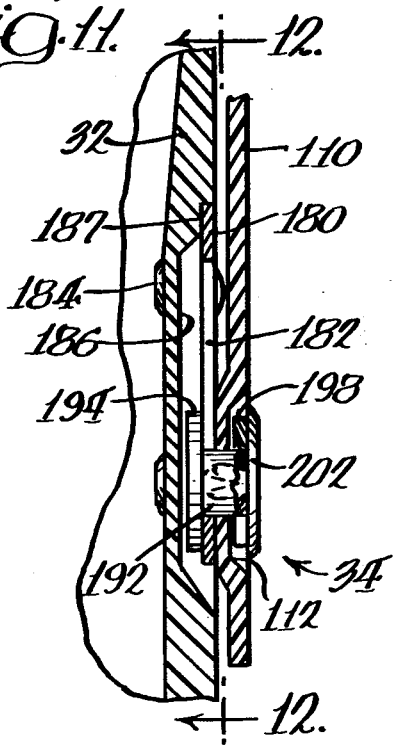
Fig. 12.
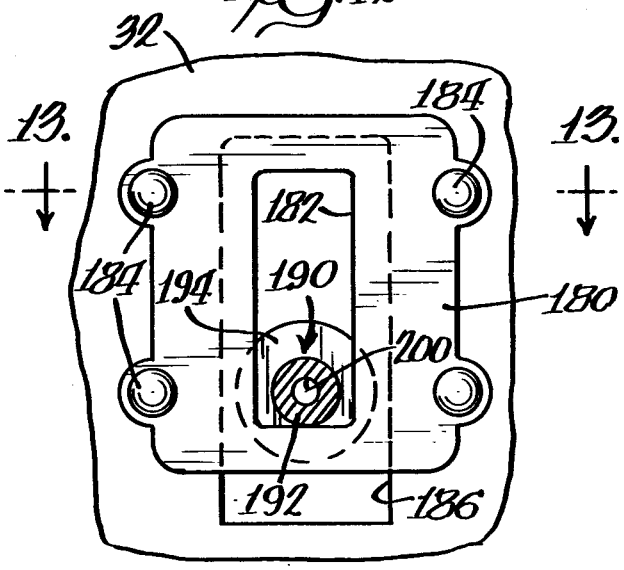
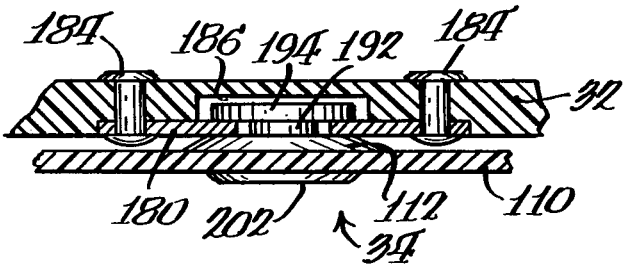
Fig. 13.

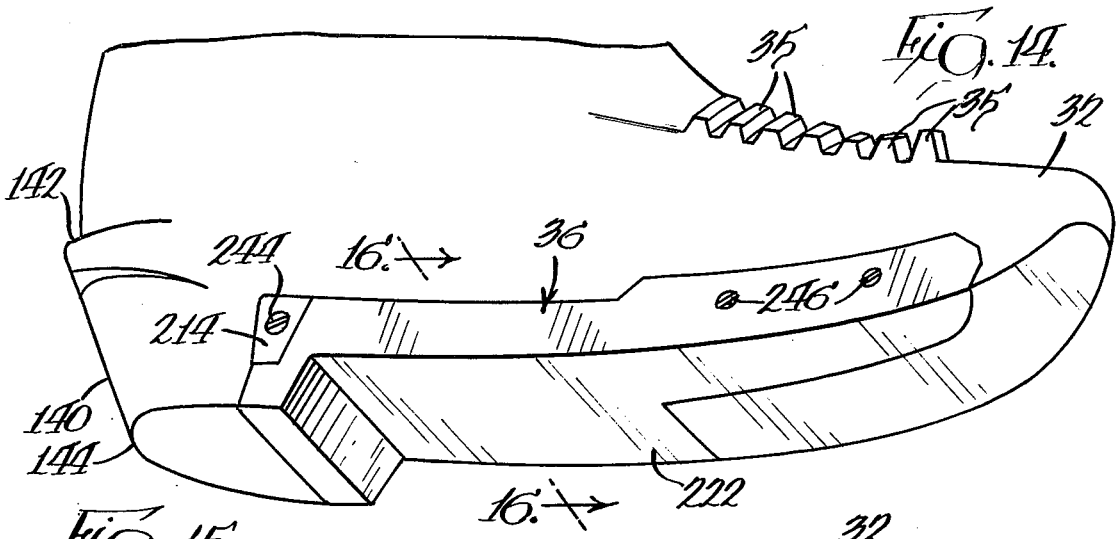
FIG. 14.
FIG. 15.
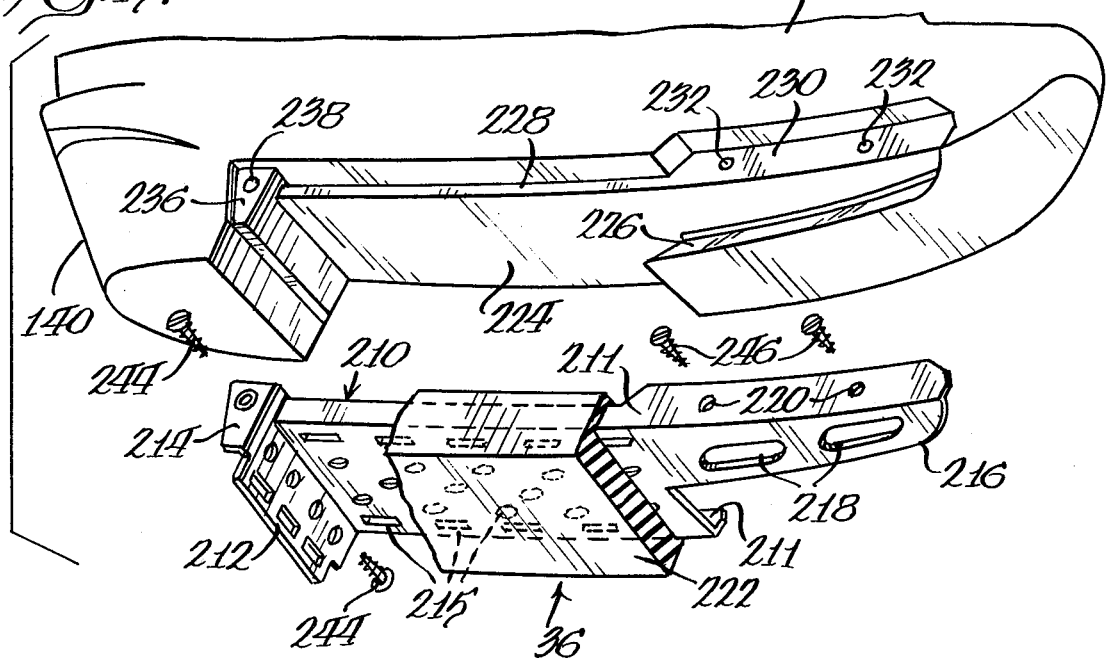
FIG. 16.
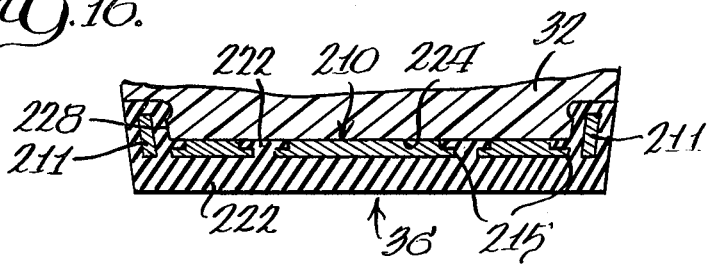

BOOT WITH HINGED UPPER

BACKGROUND OF THE INVENTION

This invention relates to a boot having a hinged upper shell and a closure system therefor.

Boots used for motorcycle racing and the like have traditionally used flexible leather uppers with sufficient thickness to protect the lower leg against airborne rocks while still allowing some flexibility of movement and feel in the lower foot region. Ski boot technology, which offers potential advantages of increased protection and durability, has found limited use in motorcycle boots because of numerous unsolved problems.

To allow relatively free hinging movement of the upper shell relative to the lower vamp shell, the front and rear edges of both the upper shell and the vamp shell have been separated apart to allow the clearance for the upper shell as it moves forward and rearward. A less rigid material has been located in the front and rear clearance gaps to enclose the shell and provide protection. However, this less rigid material has not provided the same degree of protection against flying rocks. Also inadequately protected has been the wearer's shin near the knee area, which has not been covered by the motorcycle boot, and the lower shin, which has been covered but with a material which will not withstand extreme impact.

Some attempts have been made to utilize plastic parts or plastic coated parts in motorcycle boots. Entry into the boot has been restricted and uncomfortable. Plastic parts increase the difficulty of adequately waterproofing the boot and insuring a tight seal against mud and flying objects.

Closure of the upper shell, in some motorcycle boots as well as in ski boots and other sports boots, has been accomplished by overlapped side edges releasably secured by over-center buckles latched within one of several adjustment teeth. A reverse load, which causes the upper to contract, can pop the over-center buckles out of their latched position. Also, the buckles have been exposed to obstructions and could be snagged by external objects.

While ski-type boots are known which allow rocking sideways movement of an upper shell relative to a lower shell, in addition to pivoting forward and rearward movement, the hinge assembly has had externally mounted or externally accessible critical parts which thus are exposed to mud, flying pebbles, and other adverse conditions. The complexity of prior hinge assemblies has increased the possibility of maintenance problems and jamming. Prior hinge assemblies have had critical parts extending through the lower vamp shell and thus create waterproofing problems. Also, the degrees of movement between the upper and lower shells have been inadequate, or have not provided sufficient range of movement to equal or improve on leather boots.

Another problem with plastic boots is that the sole of a motorcycle boot must have some resiliency and flexibility to provide adequate grip, which characteristics are not present in a vamp shell formed of a rigid plastic material. However, the flexible sole found on traditional motorcycle boots wears quickly and greatly limits the life of the boot, and provides inadequate arch support and protection. A vamp shell of rigid plastic limits the extent to which a wearer can "feel" the motorcycle shift lever, can stand on the motorcycle peg and brake the motorcycle, and can respond to road conditions. In addition, even the rigid plastic material found in ski boots can be chewed up by the spiked motorcycle peg against which a motorcycle racer is continually placing his feet.

SUMMARY OF THE INVENTION

In accordance with the present invention, an improved boot and closure system have overcome the disadvantages of prior boots and closure systems. A relatively rigid upper shell includes a front armored plate having an upward extension for fully protecting the wearer's shin. The armored plate is hinged in the manner of a door to an upper flexible cuff having webs which interleave with the protective plate, allowing adjustment for different leg sizes while sealing out dirt and mud and providing superior protection. The upper shell assembly overlaps the entire foot receiving opening of the lower vamp shell for maximum protection. The vamp shell has a front tongue and a pair of rear tapering flaps which do not hinder the hinging and rocking movement of the upper shell relative to the lower shell.

A connector hinge assembly, which interconnects the shells to allow forward and rearward movement, rockable sideways movement, and twisting movement, is protectively located within the overlapping regions between the shells. A unique and simple pivot pin is loosely captured within an elongated slot plate mounted in alignment with a recessed pocket integral with the vamp shell to increase water protection. The slot plate is wider than the pivot pin to allow twisting motion in the upper shell.

A closure system, usable with any sports boot, includes a pair of ribs integral with a plastic strap and having spaced adjustment holes onto which is received a wire bale longitudinally movable along the strap. The bale has a center bight received within an undercut elongated slot of a latch receiver for over-center retention. An additional snap connection to prevent release of the wire bale even in a reverse load situation is provided by deflectable legs of the wire bale which snap over locking flanges on the latch receiver. The closure system is entirely covered by the closed strap which in turn is flush with the upper shell to provide a catch-free surface.

The lower vamp shell is formed of a relatively rigid plastic material having a bottom recess which captures a replaceable sole insert. The sole insert is formed by a hard carrier plate, which provides arch supper and protection from the spiked motorcycle peg, covered with a rubber material forming a traction pad. Apertures through the carrier plate are filled with the resilient material to transmit pressure to the foot and thus increase the feet of the boot. The sole insert is positively locked on the vamp bottom, and is easily replaceable in the field. Nonslip grip ridges are raised above the upper toe surface of the vamp shell for positive control of the motorcycle shift lever. The heel of the vamp shell is angled to minimize edge catching surfaces.

Improved comfort, control, and waterproofing are provided by a flexible inner liner sealed to the lower vamp shell and extending through the upper shell. A replaceable, custom-fit bootie is maintained within the vamp shell by ears releasably secured to the inner liner.

One object of the present invention is the provision of a boot having a pivoted, relatively rigid upper shell with overlapping closure regions and impact protective extensions for providing maximum foot protection while not hindering the pivoting action, the ability to expand and contract the shell size, and the ease of entry into the boot.

Another object of the present invention is the provision of a boot having a unique simple hinge assembly for interconnecting upper and lower shells to allow pivoting, rocking and twisting motion of the upper and lower shells, and which is protected from external adverse conditions.

Still another object of the present invention is the provision of an improved closure system for a sports shoe having over-center retention combined with additional snap retention for maintaining the over-center closure in reverse load situations, and a simple longitudinal adjustment mechanism. A closure system can be mounted flush with a boot shell to form a catch-free surface.

A further object of the present invention is the provision of a boot having a relatively rigid vamp shell with a replaceable sole which is positively locked on the shell and is readily removable in the field. The replaceable sole provides arch support and protection, yet transmits external forces through an armored plate to increase the "feel" of the boot.

Other objects and features of the invention will be apparent from the following description and from the drawings. While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated.

BRIEF DESCRIPTION OF THE DRAWINGS

FIG. 10 is a side view of the boot in the vicinity of the connector hinge assembly;

FIG. 11 is a sectional view of the hinge assembly, taken along lines 11—11 of FIG. 10;

FIG. 12 is a side plan view, partly in section, of a portion of the hinge assembly, taken along lines 12—12 of FIG. 11;

FIG. 13 is a top sectional view of the hinge assembly, taken along lines 13—13 of FIG. 12;

FIG. 14 is a perspective view of the bottom and side of the lower vamp shell, showing the replaceable sole insert;

FIG. 15 is an exploded view of the replaceable sole insert and mating portions of the lower vamp shell;

FIG. 16 is a sectional view of the replaceable sole insert and lower vamp shell, taken along lines 16—16 of FIG. 14;

GENERAL INTRODUCTION

Figures 1, 2:
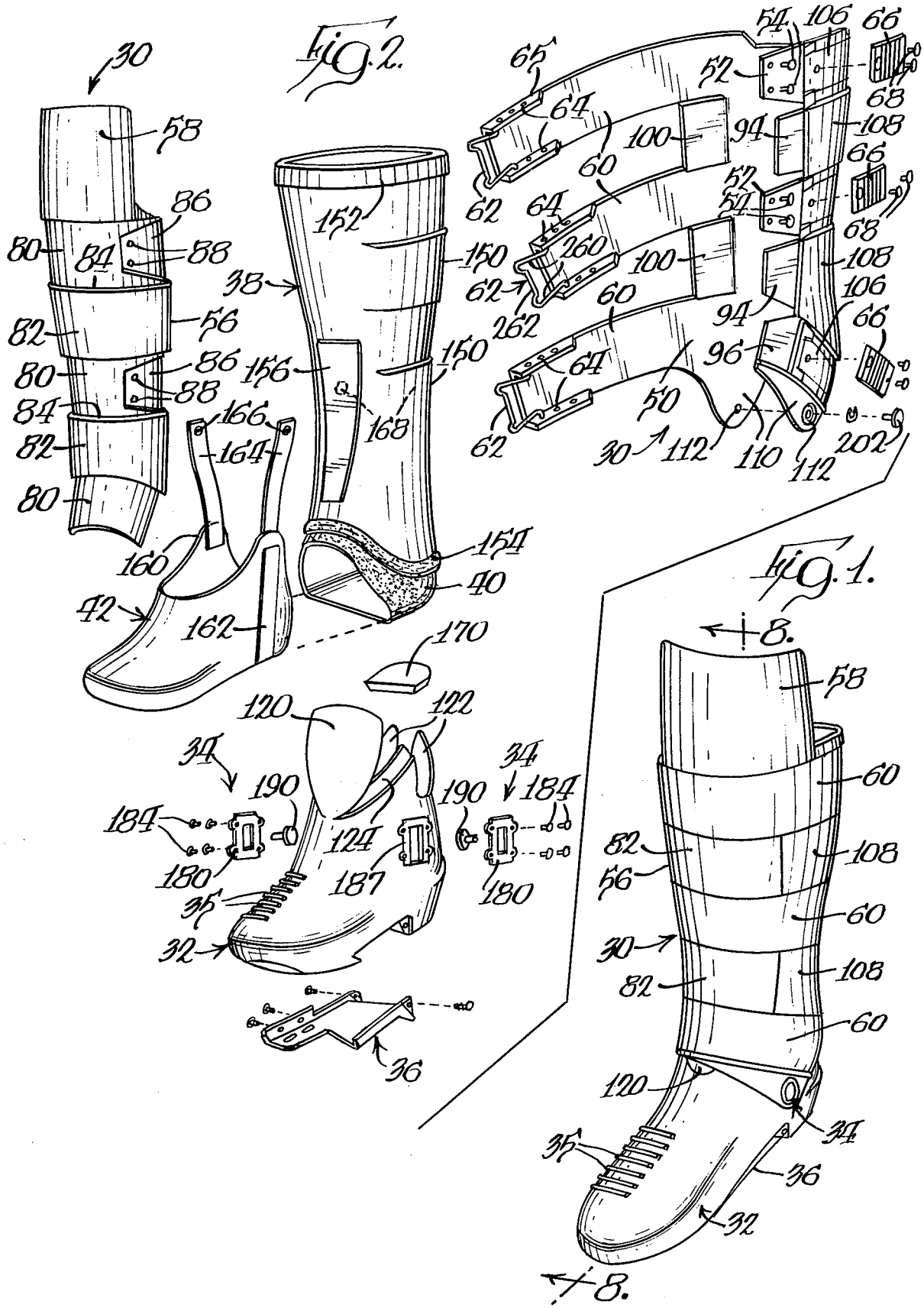
FIG. 1 is a perspective view of the boot when closed.
FIG. 2 is an exploded view of the components forming the boot.
Figure 3:
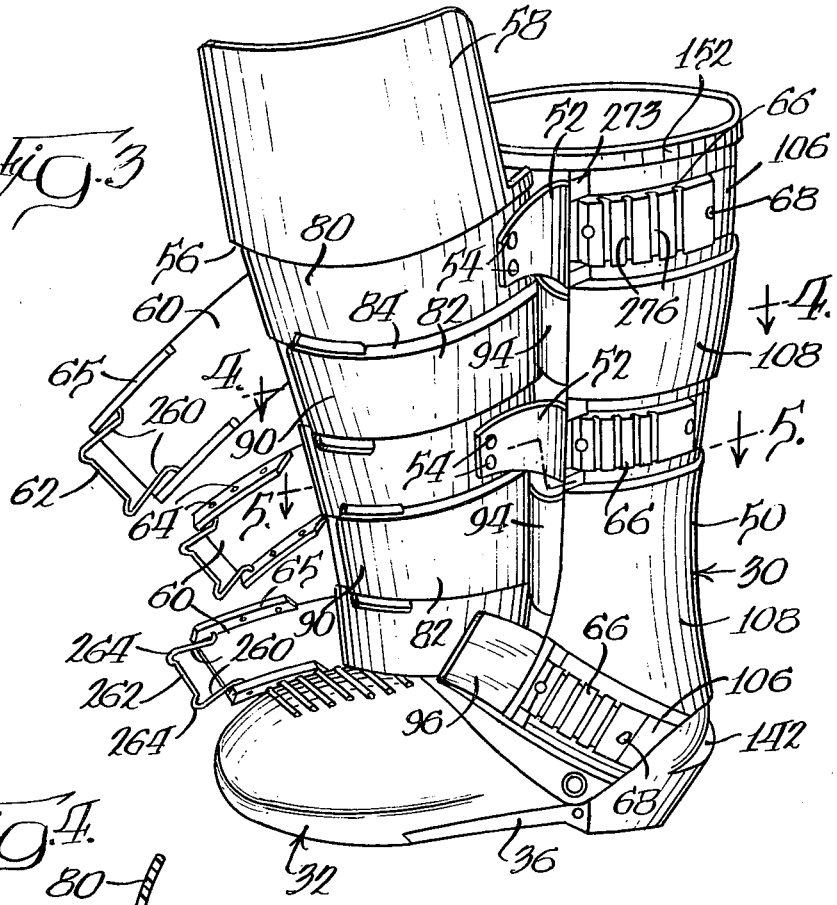
FIG. 3 is a perspective view of the boot when open and ready to receive a wearer's foot and leg.

Turning to FIGS. 1-3, a boot for motorcycle riders or the like includes a plastic upper shell assembly 30 and a plastic lower vamp shell 32 interconnected by a connector hinge assembly 34 located on each side of the boot. The connector assembly 34 allows the upper shell assembly 30 to pivot forward and rearwardly, rock sideways, and slightly twist about the longitudinal axis of the wearer's leg.

The illustrated boot is for the left foot and leg of a motorcycle rider. The top of the vamp shell 32 has a plurality of upright ridges 35 which provide a grip surface for engaging the motorcycle shift lever, which typically is located on the left side of the motorcycle. The bottom of the vamp shell 32 carries a replaceable sole insert 36 having a flexible, resilient surface or pad, which is mechanically locked to the shell bottom. The sole insert 36 provides arch support and protection from the spiked foot peg of the motorcycle, and has a forward section for engaging the motorcycle shift lever. Since the right side of a motorcycle typically contains a spiked foot peg and a brake lever, which is not engaged by the top of the motorcycle boot, the boot for the right foot may be a mirror image except that the top extending ridges 35 may be eliminated. The forward section of the replaceable sole insert 36 would thus be used to engage the brake lever, rather than to engage the shift lever as in the case of the left boot.

Both the illustrated left boot and the right boot have an inboard side, adjacent the motorcycle, and an outboard side. In the left boot illustrated in FIGS. 1-3, the inboard side corresponds to the half containing the upright ridges 35, whereas the outboard side consists of the other half. Since the inboard and outboard sides of the boot are exposed to different adverse conditions, the boot is not symmetrical but has a different upper shell configuration as appropriate for the inboard and outboard sides.

A cylindrical inner liner 38 of flexible, waterproof material is hermetically sealed at its bottom region 40 to the interior of the vamp shell 32, and extends through the upper shell assembly 30. A replaceable bootie 42 for custom fitting a wearer's foot is inserted through the inner liner 38 and extends into the vamp shell 32.

Upper shell assembly 30 includes an upper shell cuff 50 having hinge leaves 52 secured by rivets 54 to a shin protection plate 56 which forms a forward opening door, see FIG. 3. The protection plate 56 is formed of a tough, high impact resistant material which has high energy absorption, such as polypropylene. The material should have sufficient toughness to withstand projectile impacts, and exemplary has an ASTM falling dart impact test value at 32° F. in excess of 200 inch-pounds. The material also has an 85 D Shore durometer hardness. Plate 56 extends from the instep area of the wearer's foot along the shin portion of the leg, and terminates in an upward extension or skirt 58 which protrudes approximately four inches above the upper cuff 50. The leather protective pants worn by motorcycle racers may contain a plastic knee cap, and the shin plate skirt 58 is designed to reach up to the plastic knee cup, so as to leave no area of the shin exposed to the airborne objects. The entire extent of the shin protection plate 56 is approximately 14.5 inches, and is an integral part of the upper shell assembly. The protection plate 56 interleaves on the inboard side with the upper cuff 50 so as to form a seal against mud and dirt.

The upper cuff 50 is formed of a relatively rigid plastic material which is less tough and is softer than the impact plastic material of the protection plate 56. For example, the upper cuff 50 may be formed of a polyurethane having a toughness less than 100 inch-pounds as measured on the ASTM falling dart impact test at 32° F., and having a 60 D Shore durometer hardness. The cuff 50 may be RIM (reaction injection) molded into its partially cylindrical shape. The upper cuff has integral extending flexible straps 60 which wrap around the protection plate 56 and are secured to the opposite side of the upper cuff by an adjustable closure system.

The adjustable closure system is usable with ski boots, sports boots and shoes as well as the illustrated motorcycle boot. The system includes wire loops or bales 62 which are longitudinally adjustable within pairs of pivot holes 64 along side ribs 65 integrally formed in the closure straps 60. The bales 62 mate with toothed latched receivers 66 secured by rivets 68 to the outboard side of the upper cuff 50. When the wire bales 62 are latched in a closed, over-center position in the latch receivers 66, the straps 60 cover the latch receivers 66 and mesh with the cylindrical exterior of the upper shell to form a flush, catch-free surface, as seen in FIG. 1.

The vamp shell 32 has extending, tapering flaps which are deflectable together as the upper shell cuff 50 is moved forwardly, forming an approximately solid surface which closes any gaps between the upper and lower shells so as to prevent penetration of the shell system by most airborne objects. The vamp shell desirably is more flexible and less tough than the upper cuff 50 and may have a 45 D Shore durometer hardness. The combination of different toughness and hardness shells provides maximum protection where needed, and still accommodate a wearer's foot and leg in a comfortable manner.

SHELL SYSTEM

The impact protective plate 56 of the upper shell assembly has stepped, arcuate surfaces consisting of arcuate lands 80, see FIGS. 2 and 3, with intermediate raised arcuate surfaces 82 and the raised arcuate skirt 58. Between the alternate stepped surfaces are wall ledges 84 having a depth approximately equal to the thickness of the straps 60 so that the exterior front surface is flush when the straps 60 are located within the lands 80.

Along the hinged outboard side of the protective plate 56, a pair of recessed seats 86 are stamped into the top two lands 80. Each seat 86 mates with the flexible hinge leaf 52 of the upper cuff, and has apertures 88 through which the rivets 53 extend to secure the hinge leaves 52 to the protective plate 56.

Figure 4:
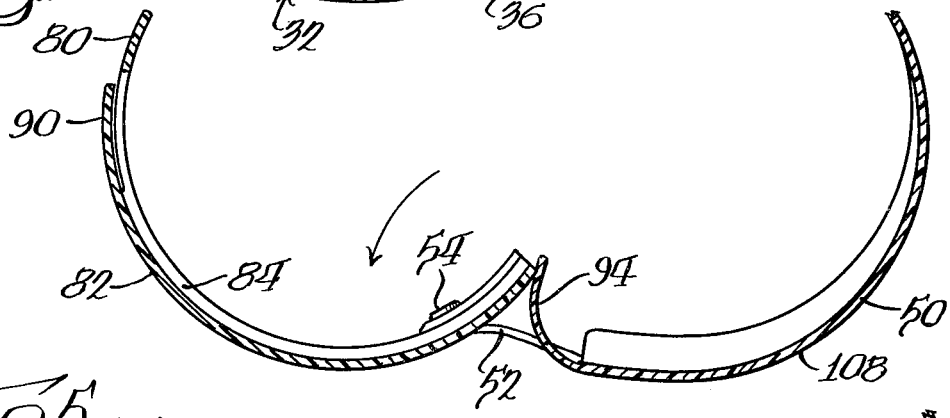
FIG. 4 is a sectional view of a portion of the upper shell assembly when open, taken along lines 4—4 of FIG. 3.
Figure 5:
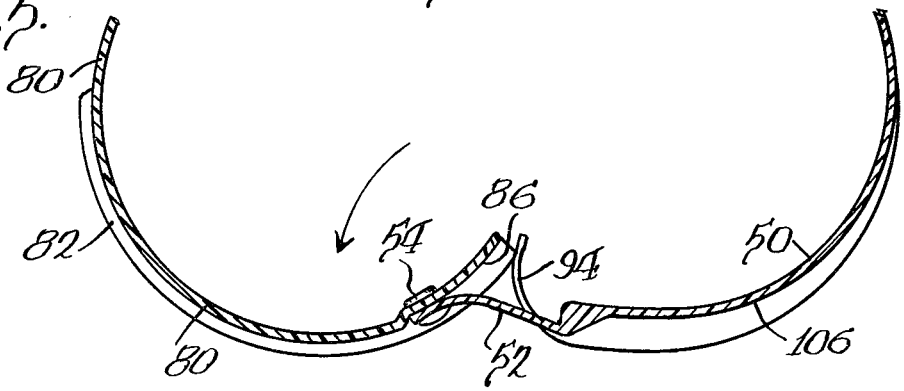
FIG. 5 is a sectional view of a portion of the upper shell assembly when open, taken along lines 5—5 of FIG. 3.

The raised surfaces 82 extend from the outboard side partially across the protective plate and terminate before reaching the inboard side. A pair of generally U-shaped cut-outs extend around the terminating portions of the raised surfaces 82 to create a pair of raised projecting flaps 90, see FIGS. 3 and 4. The cut-out portions include most of the ledge walls 84 on the two sides and the terminating edges of the raised surfaces 82, creating a pair of overhanging flaps 90 which interleave with the upper cuff.

Figure 6:
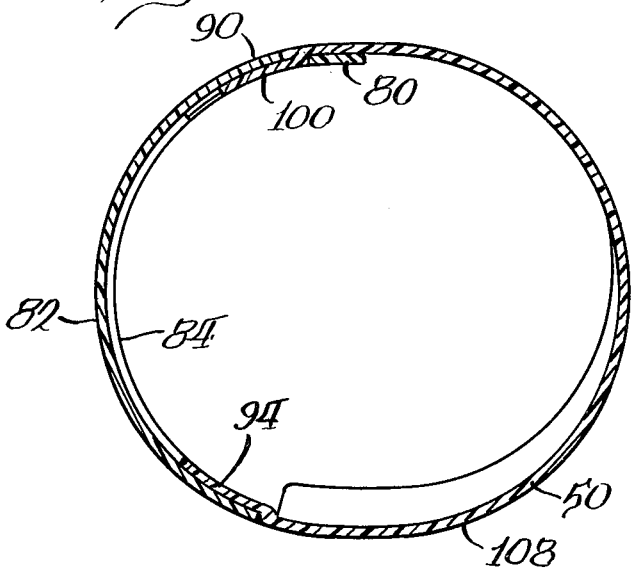
FIG. 6 is a sectional view of the upper shell assembly shown in FIG. 4, when closed.

The outboard side of the upper shell cuff 50 has a vertical edge region with integral flaps or spring latches 94, see FIGS. 2–6, which overlap or overlie the interior side of the raised plate surfaces 82 when the boot is closed, FIG. 6. As the protective plate 56 or front door is manipulated to expand the shell cylinder to allow entry of a wearer's foot, as by opening the front door, the spring bias of the flexible latches 94 push against the edge of the protective plate 56 to maintain the same in a latched open position, FIGS. 3–5. A guide flap 96, FIGS. 2 and 3, overlies the exterior of the lower land 80 and slidably guides the protective plate during opening and closing so as to allow proper functioning of the spring latches 94.

The opposite vertical edge region, along the inboard side of the upper shell cuff 50, includes a pair of interior elements or webs 100, FIGS. 2 and 6, located between and recessed inward from the straps 60. As the door plate 56 is closed, the flaps 90 or exterior elements ride over the recessed webs 100 or interior elements to form an interleaved interface of alternate overlying portions of the door plate 56 and the upper shell cuff 50, see FIG. 6. The recessed webs 100 will underlie only a portion of the overhanging flaps 90 when the boot is adjusted to a larger size. Desirably, the cuff and shell are interleaved on the inboard side for all adjustable sizes of the boot to provide an effective seal against dirt and mud.

The outboard side of the upper cuff 50 has stepped surfaces which mate with the corresponding stepped surfaces on the protective plate 56. These stepped surfaces smoothly converge toward the recessed surfaces and finally terminate at the rear center line of the boot. The arcuate cuff surface on the inboard side is smooth until reaching the edge region.

Figure 7:
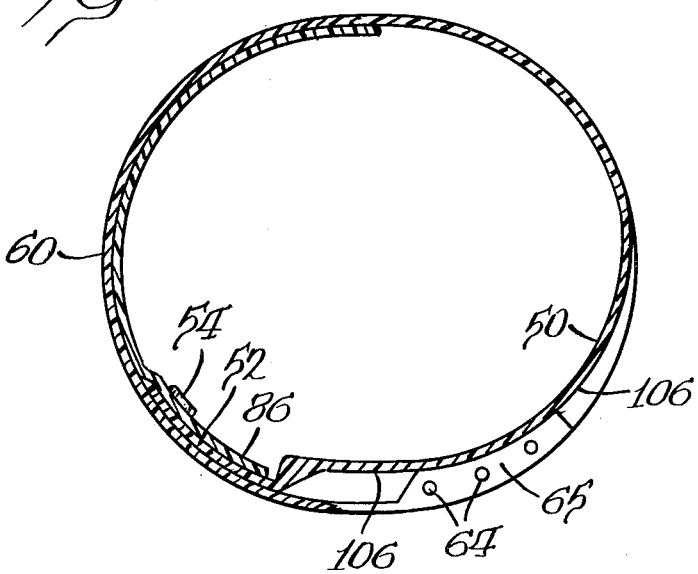
FIG. 7 is a sectional view of the upper shell assembly shown in FIG. 5, when closed.

Returning to the outboard side of cuff 50, three channels or lands 106 are in circumferential alignment with the door lands 80, and mount the latch receivers 66 which receive the wire bales 62 pivoted on strap 60. Between the lands 106 are raised surfaces 108 in circumferential alignment with the door raised surfaces 82. When the straps 60 are latched by the latch receivers 66, see FIG. 7, the height of the strap and integral rib 65 away from the lands 106 is equal to the height of the raised surfaces 108 away from the lands 106, creating a catch-free, flush exterior surface.

Upper shell cuff 50 has a lower region 110, FIG. 2, which overlaps the entire upper portion of the lower vamp shell 32 to provide maximum protection against flying objects. At the sides or ears of the lower region 110, a pair of counter-sunk apertures 112 receive portions of the hinge connector assembly 34 for lost motion connection to the lower vamp shell.

Figures 8, 9:
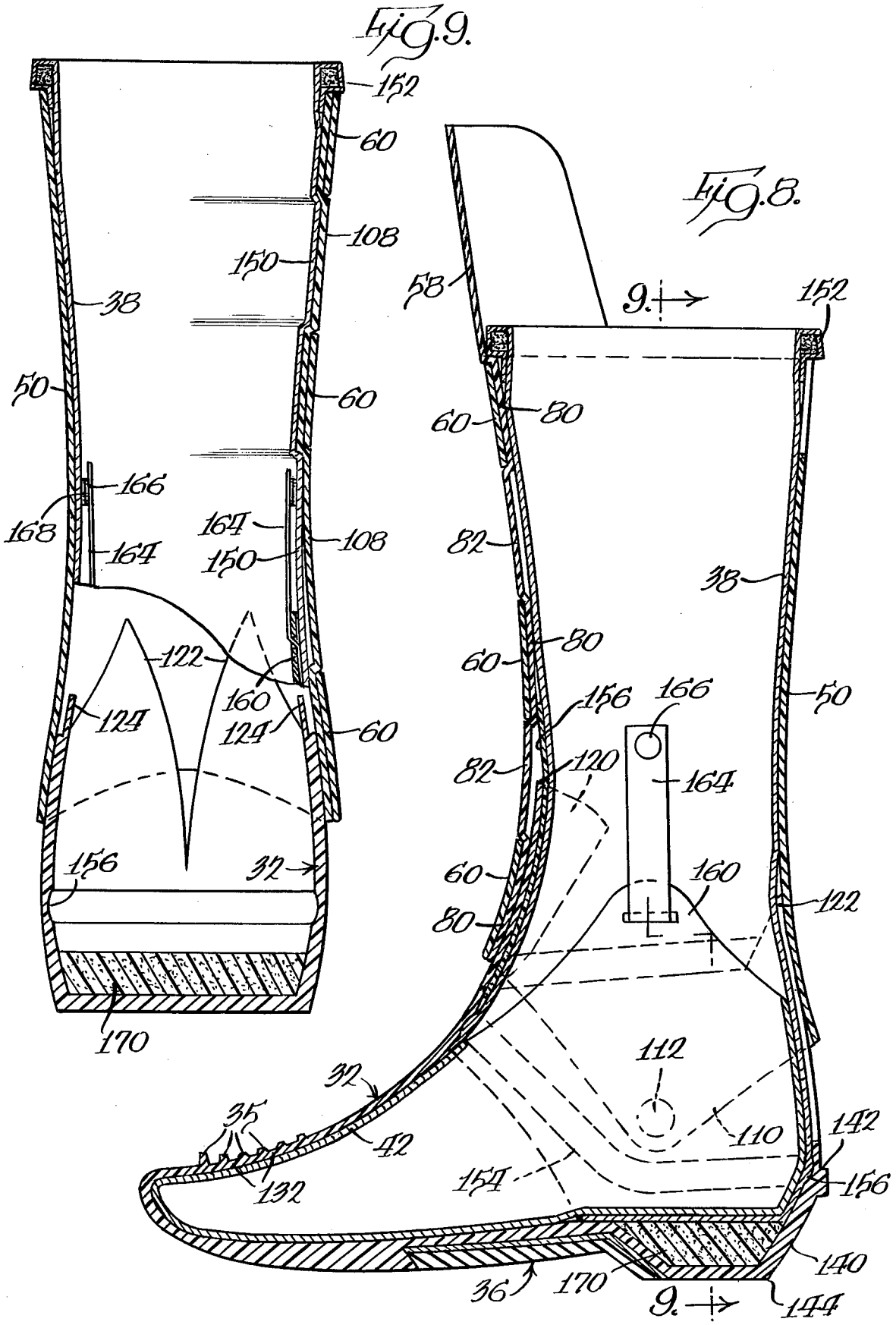
FIG. 8 is a side sectional view of the closed boot, taken along lines 8—8 of FIG. 1.
FIG. 9 is a rear sectional view of the closed boot, taken along lines 9—9 of FIG. 8.

Lower vamp shell 32 has a foot opening defined by a forward flap or tongue 120 and a rear gator formed by a plurality of elongated, flexible, tapered fingers or flaps 122, see FIGS. 2 and 9. A pair of thin webs 124 are recessed inward from the upper forward portion of the vamp shell and underlie the tongue 120 when the tongue is depressed rearward so as to seal the space therebetween. The tongue 120, rear flaps 122, and web 124 may all be molded as an integral part of the vamp shell, although each could be separately molded and mechanically attached thereto. The rear fingers or flaps 122 taper in width towards a point, see FIG. 9, and press against the inner surface of the lower cuff region 110, FIG. 8. The tapering flaps 122 form a homolosine equal-area projection of a sphere onto a surface or plane. As the flaps 122 are pushed inward by the upper cuff when pivoted forward, the facing sides of the flaps 122 converge and abut to form a spherical surface. The foot fitting shape of the vamp opening generally does not allow exact abutting of the flaps to form a solid spherical surface, however, an approximation is formed which substantially closes the gap between the flaps 122 so as to prevent penetration of the shell by most airborne objects. Although only a pair of tapering flaps are illustrated, a larger number of thin flaps or fingers may be provided around the vamp opening to provide a similar function. Similar tapering fingers or flaps can be provided at the front of the vamp opening, however, the tongue 120 has been found to provide better flexing action while also sealing the front opening against penetration by airborne objects.

Various modifications could be made while still providing some of the advantages of the surrounded armor-like shield with free-flexing action. For example, a bellow-like gator could be used between the upper and lower shells. Or, the flaps 122 could be formed of widths greater than the spacing therebetween, in the manner of elongated plates which overlap, so that a compression thereagainst would cause adjacent flaps to slide further behind the next flap.

On the top or upper of the inboard side of the vamp shell, the plurality of ridges 35 provide a nonslip gripping area for the motorcycle shift lever. As seen in FIG. 8, the ridges 35 are integrally molded as a part of the vamp shell and preferably extend above the remaining upper surface of the vamp. Between the ridges 35 are elongated valleys 132 which extend below the upper surface. Each ridge 35 extends from approximately the middle or center of the front region, to the edge of the inboard side. The ridges 35 rise upward by an increasing amount near the toe or front of the boot, with the first ridge being the highest. This provides an upward slope to prevent the shift lever from sliding off of the front of the boot. Thus, the extending ridges provide "feel" and a nonslip grip for the motorcycle shift lever.

The gearshift lever grip area could be provided by cross-hatch recesses formed to weaken an otherwise smooth upper vamp. The depth of the recesses would be selected to allow some flex to the inboard top region. However, such cross-hatch recesses are less preferred than the three dimensional upright ridges 35 which provide better traction.

The lower vamp shell has a skewed heel 140 seen best in FIGS. 8, 10 and 14. A horizontal ledge 142 forms a stop surface against which the rear lower edge of the upper shell cuff 50 abuts when rotated rearward to a maximum rear lean angle. The ledge 142 extends downwardly into the skewed heel which is at a substantial angle to vertical. As a result, the outer edge 144 between the rear of the heel and the bottom thereof makes an obtuse angle substantially greater than 90°, and which is located substantially forward with respect to the usual square heel. The motorcycle rider is thus less likely to catch the heel of the boot when extending the inside leg while making a turn on the motorcycle. This practice of extending the inside leg forward and down to help balance the motorcycle in a turn is common to dirt motorcycle racers. The present heel 140 is less subject to catching and throwing the rider off balance.

LINER SYSTEM

The liner system consists of the waterproof inner liner 38 and the replaceable bootie 42. Liner 38 may be blow molded and preferably has a pair of stepped or raised surfaces 150 on the outboard side which mate with the raised surfaces 108 of the upper cuff, see FIGS. 2 and 9. The top of the generally cylindrical liner 38 is folded over a foam insert 152 and the folded over top of the liner is glued to the abutting exterior liner surface. The foam insert 152 is located so as to overlie the upper edge of the cuff, as seen best in FIGS. 8 and 9 to minimize water and foreign particles from entering between the inner liner and the cuff.

The bottom 40 of the cylindrical liner has a full heel with a forward facing opening. An encircling bead 154 integral with the bottom 40 is snugly received within a corresponding recess 156, FIG. 8, in the lower vamp shell 32. The bead 154 and the entire bottom heel surface 40 located below the bead are glued into the lower vamp shell to form a hermetic seal. The bead 154 surrounds the entire foot receiving opening of the lower vamp shell and thus prevents water from entering the vamp shell and reaching the wearer's foot.

To prevent undue abrasion between the pivoting tongue 120 and the inner liner 38, a wear strip 156 of flexible plastic of one or more layers is glued to the front of the inner liner 38, as seen in FIGS. 2 and 8.

To custom fit the boot interior to different size feet, a replaceable bootie 42 is inserted through the inner liner 38 and extends into the vamp shell. The bootie has a heel which abuts the heel of the liner 38. Different size replaceable booties are formed by molding urethane foam of different thickness over a nylon sock having the bootie shape. The bootie has a pair of side ears 160 which are releasably secured to the inner surface of the liner 38 so as to hold the bootie in place when the wearer inserts his foot through the liner 38. The detachable fastener may be formed by various structures such as fabric or mechanical fasteners which connect the ears 160 to the inner surfaces of the liner 38. Illustratively, the fasteners consist of a nylon stirrup or guide strap 162 which extends externally around the bottom of the bootie, and has terminating ends 164 which extend through side slots in the ears 160 and terminate in snap fasteners 156 which mate with snap fasteners 168 located on the interior sides of the inner liner, see FIGS. 2, 8 and 9.

The heel portion 140 of the lower vamp shell is hollow so as to reduce the plastic material and weight. A heel cube 170 formed of styrofoam is inserted in the recessed pocket or hollow before the bottom region 40 is glued within the vamp shell.

CONNECTOR HINGE ASSEMBLY

The connector hinge assembly 34 for allowing pivoting forward and rearward motion, sideways rocking motion, and lateral twisting motion of the upper shell relative to the lower shell is illustrated in detail in FIGS. 2 and 10–13. The assembly includes a metal slide frame or plate 180 which has an elongated track or guide slot 182 located therein.

The metal plate 180 is external to the vamp shell 32 and is attached by four rivets 184 to a recessed seat 187 in the vamp shell 32, with the elongated vertical slot 182 being aligned with an elongated vertical depression or pocket 186 further recessed from the seat 187 and integrally molded in the vamp shell 32. The depth of the seat 187 equals the thickness of the plate 180 so as to mount the plate flush with the vamp shell exterior wall. The vamp pocket 186 extends vertically downward beyond the metal plate 180, as best seen in FIGS. 10 and 12, to allow water, mud and the like to readily escape from the vamp pocket 186. A sealer or epoxy may be placed over the rivets 184 so as to insure that the lower vamp shell 32 is water tight. Alternatively, the lower vamp may have integral extending posts, which extend through the four rivet holes in the plate 180 to secure the plate tightly against the vamp by use of capturing lock washers or other means.

Slidable within the slot 182 is a lost motion connector in the form of a pivot pin 190 having a reduced diameter neck 192 attached to an enlarged head 194 captured between the plate 180 and the shell pocket 186. The pin neck 192 has a diameter which is less than the width of the generally rectangular slot 182, and substantially less than the length of the rectangular slot 182. Similarly, the diameter of the head 194 is less than the width of the generally rectangular pocket 186, and is substantially less than the length of the rectangular pocket, see FIGS. 12 and 13. These dimensions cause the pivot pin 190 to form a lost motion connection which is free-floating within the slide plate, i.e., has no fixed pivot point either horizontally or vertically, but rather has a range of pivot points.

The pivot pin neck 192 extends through and is journalled within a countersunk, conical bore 112, FIG. 2, located in the vicinity of the wearer's ankle. A retaining ring 198, FIGS. 10 and 11, is snapped into an annular groove in the neck 192 so as to capture the upper shell for movement about the movable axis of the pivot pin. The pivot neck 194 has a hollow axial bore 200 which receives a plastic button insert 202 which covers the retaining ring 198 to improve visual appearance and provide protection against mud and dirt. When the pivot pin 190 is located within the lower regions of the elongated slot, the entire plate 180 is covered by the overlapping lower region 110 of the upper shell and hence is protected from external adverse conditions.

The connector assembly 34 allows three types of motions of the upper shell relative to the lower shell. Pivoting forward and rearward motion of the upper shell, corresponding to clockwise and counterclockwise rotation of the region 110 relative to the pivot neck 192 as viewed in FIG. 10, is produced by rotation of the pivot pin and/or rotation of the region 110 about the pivot neck 192. Rocking sideways motion of the upper shell relative to the vamp is provided by the vertical extent of the slots 182 which allow the pivot pin to slide vertically upward and downward. Finally, twisting motion or rotation of the upper shell about the longitudinal axis of the upper shell is provided by the horizontal extent of the slot 182 which allows the pivot pin 190 to slide to the right and left as viewed in FIG. 12.

Since the circular bore 112 in the upper shell is only slightly larger than the diameter of the pivot neck 192, and is covered by the plastic button 202, very little foreign matter can enter from the side and jam the pivot assembly.

Various modifications can be made to the connector assembly 32. If twisting motion is not desired, the width of the elongated slot 182 can be made only slightly larger than the diameter of the pivot neck 192. If less rocking motion is desired, only one movable pivot need be provided, with the opposite side of the upper shell assembly being interconnected by a simple pivot pin fixedly secured to the vamp shell. Rather than the elongated slot 192, a circular opening of greater diameter than the diameter of the pivot neck may be provided, with the diameter of the enlarged head being greater than the diameter of the circular opening, to also create a free-floating pivot pin which has no fixed pivot point. However, such a free-floating pivot will provide differing amounts of twisting motion dependent on the vertical position of the pivot neck within the circular opening.

REPLACEABLE SOLE INSERT

Turning to FIGS. 14–16, the replaceable sole piece or insert 36 and mating vamp shell are illustrated in detail. While the insert desirably extends over the illustrated bottom area which is subject to high wear, it can be changed in shape to cover a greater or a lesser portion of the boot sole, as desired. A hard plastic carrier 210 with a U or channel cross section is formed by a flat plate having side flanges 211 which strengthen the plate, and a downward heel extension 212 containing rearward, outturned lock ears 214. The material of the carrier may be glass loaded ST nylon. The carrier plate is perforated with a plurality of circular and rectangular apertures 215 spaced through its surface. The perforations consist of reduced diameter necks which open, adjacent the vamp shell, into enlarged heads, as seen in FIG. 16.

The front of the channel includes a forward section or elongated finger extension 216 which extends only partly across the width of the sole, and contain two large oval apertures 218 which are substantially larger than the perforations 215. Finger extension 216 is L-shaped and its side flange contains two apertures 220 therein.

By use of insert molding, a gripping traction pad 222 of rubber or other relatively resilient material with respect to the relatively rigid material of the vamp shell is integrally and permanently molded to the bottom and around the side flanges and heel extension of the hard carrier 210, except the rubber does not extend over the ears 214. Insert molding involves placing the premolded hard plastic carrier 210 in a mold, and shooting in molten rubber that surrounds the carrier and expands within the perforations, forming a one-piece unit with no possibility of delaminating. While the rubber bottom 222 is illustrated with a smooth surface, various grid or other traction patterns can be molded into the exposed bottom.

The lower vamp shell 32 has a bottom recess which conforms to the shape of the sole insert 36. The bottom recess is defined in part by a vamp shell base 224 and skewed, under-cut forward edges 226 integrally molded in the vamp shell 32. The rubber pad 222 is molded with skewed front walls or edges which can be slid under the under-cut edges 226 and mate therewith to mechanically lock the sole piece against vertical motion.

The base 224 has upward sides 228, skewed slightly inward, and recessed from the exposed sides of the vamp shell. On the inboard side of the vamp, the recessed side 228 extends forwardly to accommodate the finger extension 216, and has an additional vertical extent 230 so as to accommodate a pair of screw holes 232 which align with screw holes 220 in the finger extension 216. The heel area has a pair of recessed sides 236 containing screw apertures 238 which align with countersunk apertures in the ear 214.

The carrier ears 214 have a slight rear skew so that the sole insert 36 is snap-fit into the base recess by inserting the forward skewed rubber edge into the undercut walls 226, and slightly bending the carrier so that the ears 214 extend fully into the recessed sides 236. If the carrier is made of a plastic or metal sufficiently rigid to prevent any flexing, the ears 214 should have a straight vertical extent so as to slide straight into the mating recess. An additional mechanical lock is provided by a pair of locking fasteners as screws 244 which extend through the pair of side heel ears 214, and by a pair of locking fasteners as screws 246 which extend through the side flange 220 to secure the finger extension 216 to the side of the vamp shell.

The hard plastic carrier 210 provides a high level of arch support and protection to the bottom of the foot when riding over rough terrain or landing off of jumps. It also prevents the spiked motorcycle peg from chewing through the base of the vamp shell 32. The rubber pad 222 provides the proper feel and traction in the area of the sole, adjacent the heel, which is used to stand on the motorcycle peg.

The inboard finger extension 216 with its surrounding rubber pad 222 provides a nonslip grip area for the shift lever of the motorcycle. This forward grip section, in combination with the nonslip raised ridges 35 located directly above on the top of the vamp, provide positive control over gear selection.

The enlarged apertures 218 in the finger extension 216 allow a substantial amount of rubber 222 to extend through to the base 224 of the vamp shell. The flexible rubber transmits forces from the shift lever or brake lever through to the flexible base of the vamp shell and hence to the wearer's foot, providing a "feel" for the lever which would not be possible if the protective carrier 210 were solid or substantially solid. Thus, a high degree of protection is provided while still giving the feel of a much softer boot.

The sole insert 36 is readily released by removing the screws 244 and 246 and pulling out the old insert 36, which then can be replaced with a new integrally molded insert. Because the attachment system uses no bond joints, it is feasible to quickly replace the sole insert in the field. The useful life of the motorcycle boot is greatly increased because only the high wear area of the sole needs to be replaced.

Various modifications can be made to the replaceable sole insert. The finger extension, illustratively located on the inboard side above the appropriate motorcycle levers, can be extended across the entire vamp so as to prevent uneven wear between the adjacent rubber and plastic. Although the rubber 222 extends over the vamp sides to provide a nonslip side area, the sole insert can be limited to any portion of the bottom of the sole. If limited to a small area such as under the instep, the insert could be made of a self-supporting, flexible plastic, eliminating the hard carrier. By use of opposed skewed edges, a limited area insert can be locked to the vamp recess without the use of screws.

While less preferable, the entire sole area can be made replaceable. In place of the insert 36, a flexible, rubber-like outer shoe can snugly engage the entire sole and sides of the boot (in which event no base recess is provided). Such an outer shoe may have a bead around its lip, which is snugly received within a groove encircling the vamp shell. A waterproof, rupturable seal may be formed by a solvent based contact cement or adhesive, such as nitrile-phenolic solvent cement, which can coat the entire inner part of the outer shoe including the bead and surrounding area, so as to semipermanently attach the shoe to the vamp. After such a shoe sole has worn sufficiently, a solvent may be applied to allow the shoe sole to be pried loose from the vamp, after which a new shoe sole can be sealed by the same type of solvent based contact adhesive. Since such a shoe sole does not provide arch support and protection, a separate protection plate may be embedded in the base of the vamp, beneath the instep arch of the wearer's foot. The protection plate may be formed of metal, hard plastic, or a Kevlar cloth of 0.100 inches thickness extending from the heel to the ball of the foot. The cloth is put in the mold prior to injecting with plastic. When saturated with plastic, the Kevlar cloth produces a much stiffer plastic in order to offer arch support and arch protection.

CLOSURE SYSTEM

The adjustable closure system is best shown in FIGS. 2, 3 and 17–22. Although the closure system is illustrated in conjunction with the motorcycle boot, it can be used to releasably latch any pair of closable portions of a sports shoe such as a ski boot or the like.

The clamping loop or bale 62 is formed by a wire bent into a generally U-shape having a pair of deflectable side legs 260 and a center bight 262. Intermediate the legs 260 and the bight 262 are a pair of centering ears or tabs 264. The legs terminate in outturned pivot ends 266 which are rotatably located within aligned adjustment holes 64 in the pair of side uprights or ribs 65 molded integral with the straps 60. The wire bales 62 can be moved longitudinally along the straps pushing inward on the pair of legs 260 so as to withdraw the pivot ends 266 from an aligned pair of adjustment holes 64, and inserting the pivot ends 266 in other aligned pairs of adjustment holes 64.

Figure 17:
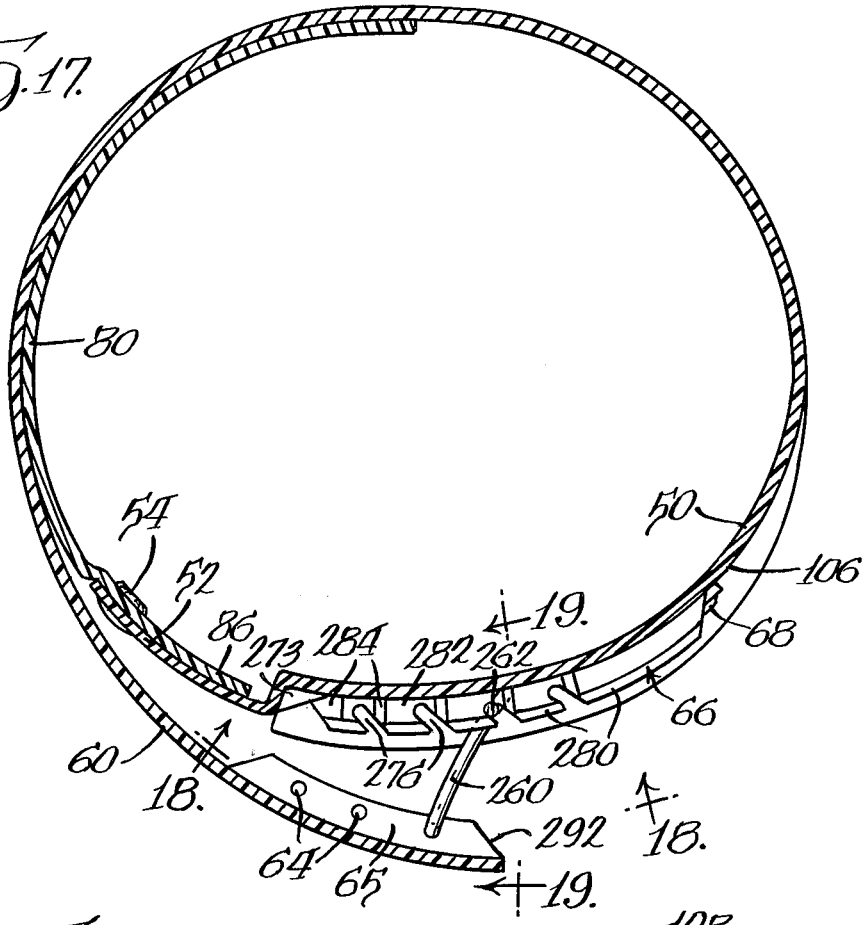
FIG. 17 is a top sectional view of the upper shell assembly with the closure system partially open.
Figure 18:
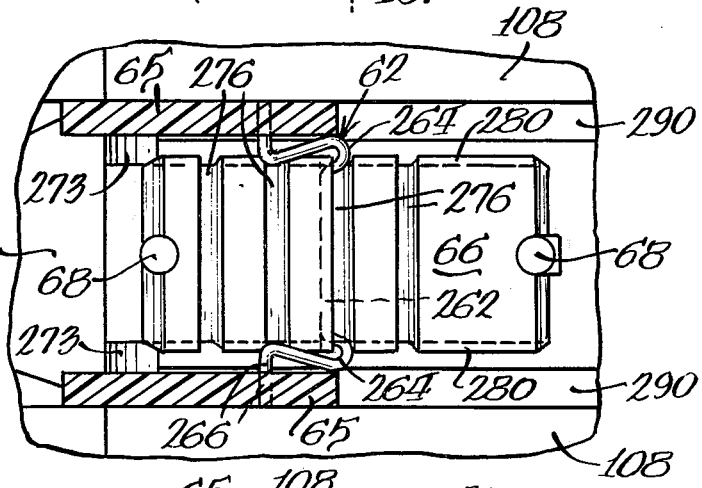
FIG. 18 is a side plan view, partly in section, of the closure system, taken along lines 18—18 of FIG. 17.
Figure 19:
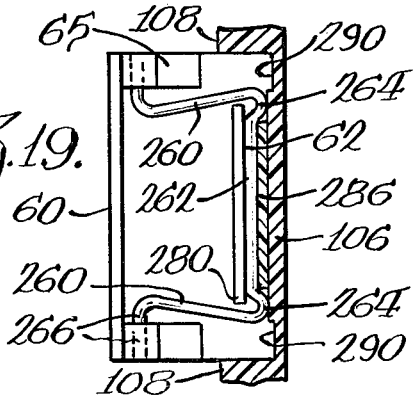
FIG. 19 is a cross-sectional view of the closure system, taken along lines 19—19 of FIG. 17.
Figure 20:
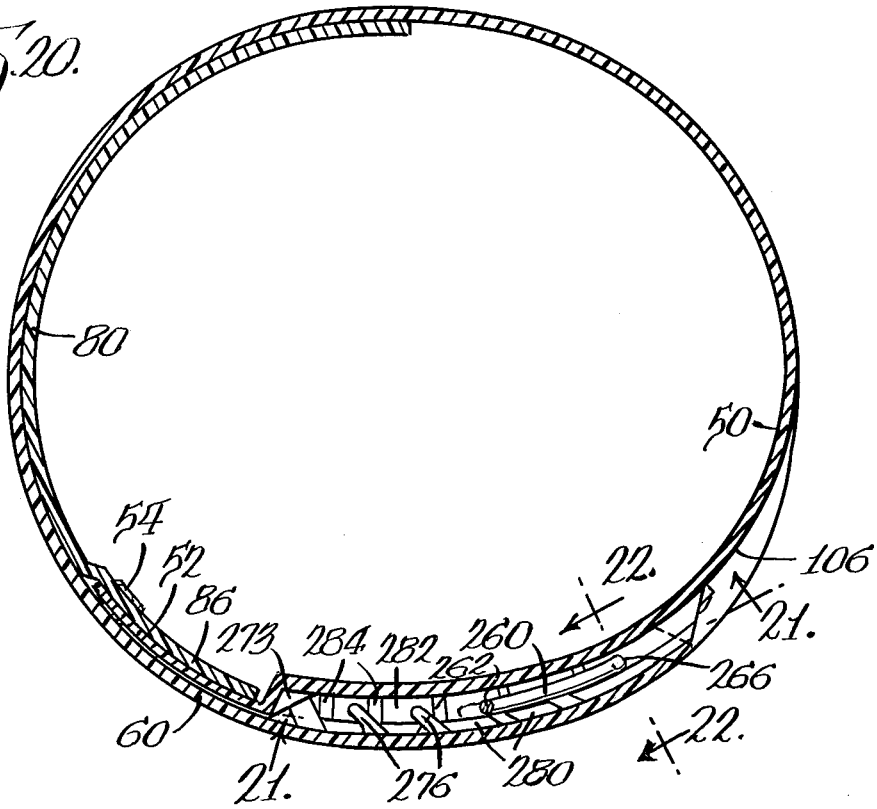
FIG. 20 is a top sectional view of the upper shell assembly with the closure system completed closed.

Each latch receiver 66 is molded of a single plastic piece and includes a plurality of elongated undercut slots or grooves 276 with the projections therebetween defining wide teeth. The grooves extend across the width of the latch receiver 66, correspond to the extent of the center bight 262. Each groove 276 is undercut so as to form an approximately 45° angle to a line normal to the top surface of the receiver, as best seen in FIGS. 17 and 20.

The arcuate top surface of the receiver 66 has a pair of overhanging edges or locking flanges 280 which form a detent or snap closure for the side legs 260. The locking flanges 280 extend beyond the last or rearmost groove 276, shown to the right in FIGS. 17, 18, 20 and 21, by a distance at least equal to the length from the center bight to the detented portions of the deflectable legs 260, so as to detentably capture the bale even when placed in the last groove. A pair of side walls extend downward from the locking flanges 280 to the upper shell land 106. Each side wall contains a recess 282 for each groove 276, located between webs 284, to provide clearance for the centering tabs 264 as the wire bale is rotated within the elongated groove 276. The webs 284 form stops which are abutted by the centering tabs 264 when the wire bale has been rotated to a maximum open position such as illustrated in FIG. 17, preventing further rotation beyond a predetermined angle.

To aid in mounting the receiver 66 to the upper shell land 106, a pair of wedge shaped tabs 273 extend from the height of the hinge leaves 52 downward to the surface of the land 106. The forward tapering end of the latch receiver is then abutted against the pair of locating tabs 273 when initially riveting the receiver to the land.

Figure 21:
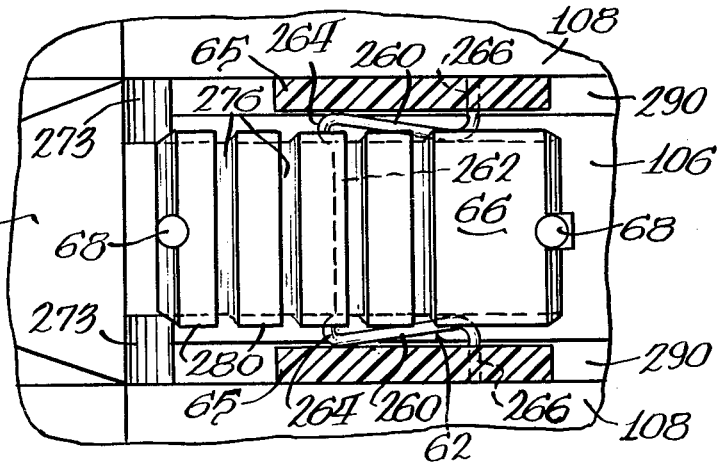
FIG. 21 is a side plan view, partly in section, of the closure system, taken along lines 21—21 of FIG. 20.
Figure 22:
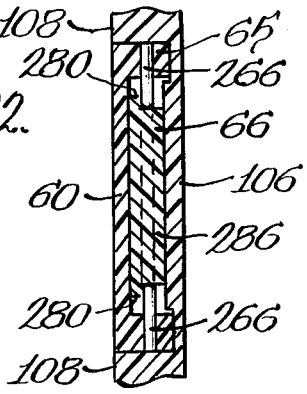
FIG. 22 is a cross-sectional view of the closure system, taken along lines 21—21 of FIG. 20.

When the boot is to be closed, the bight 262 is inserted within an elongated groove 276. The centering tabs 264 have inward skewed portions which ride against the bottom base 286 of the receiver to self center the bale. The rib portion of the strap is rotated over-center and pressed inwardly so that the deflectable legs 260 are urged outwardly over the locking flanges 280 and then spring or snap inward into the pair of locking channels located between the pair of locking flanges and the upper shell land 106, as seen in FIGS. 20–22. To insure that the bales are rotated over-center by a maximum amount, a pair of shallow grooves 290 are located on each side of the upper shell land 106, and receive the pair of ribs 65 therein.

While the side legs 260 have been detented by snapping deflectable legs 260 over relatively rigid locking flanges 280, it will be appreciated that the legs 260 could be made relatively rigid and the locking flanges 280 could be made flexible. In such a case, the bale 62 would be formed of rigid members and the legs or a rib projection therefrom would be snapped over the flexible locking flanges.

Once closed, should a force tend to circumferentially expand the boot so that the strap 60 places more strain on the outturned pivot ends 266, the over-center bale will tend to rotate inwardly about the bight toward the boot shell, and thus will maintain the clamping engagement. Unlike prior closure systems, a reverse load situation will not cause the over-center wire bales 62 to pop out of their toothed grooves. As a force tends to reduce the shell circumference, so that the strap 60 slides to the right as viewed in FIGS. 20 and 21, the snap closure formed by the legs 260 located under the locking flanges 280 will maintain the bight within its groove.

To release the closure system, the wearer inserts his fingers under the skewed ends 292 of the ribs 65, see FIG. 17, and lifts outwardly with respect to the boot. The detented legs 260 will be urged outwardly and snap over the locking flanges 280, at which time the strap can be lifted so as to remove the bight from the elongated groove.

A wide range of adjustments are possible due to the number of grooves 276 in the receiver and a number of adjustment holes 270 and the strap.

When the latch is closed, the wide strap 60 and integral side ribs 65 entirely cover and protect the closure system. The latch receiver is desirably located within a shallow channel 106 having a depth equal to the height of the strap and integral ribs, so that when the latch is closed (as seen in FIGS. 1, 20 and 22) the closure system is flush with the exterior wall of the boot so as to create a catch-free surface. The latch receiver 66 can be integrally molded as a part of the upper shell wall, if desired, but this increases the complexity of the mold, and also makes it difficult to replace a defective or broken latch receiver. Should a wire bale 62 become lost or bent, it can be simply and inexpensively replaced.

We claim:

1. A boot comprising:

a lower shell for containing a wearer's foot, an upper shell assembly including an arcuate front plate formed of a high impact material and having an upwardly extending protective skirt, a separate arcuate rear cuff formed of a material less tough than the front plate, the front plate and the rear cuff forming a generally cylindrical shell with the protective skirt protruding vertically above the top portion of the rear cuff a sufficient extent to protect the wearer's shin adjacent the wearer's knee, closure means for opening and closing the cylindrical shell to allow entry of a wearer's foot and leg, a waterproof inner liner of generally cylindrical configuration and having a bottom region hermetically sealed to the lower shell, and a replaceable bootie insertable through the inner liner and into the lower shell for fitting a wearer's foot, and connector means interconnecting the upper shell assembly to the lower shell for pivoting movement therebetween.

2. The boot of claim 1 including a guide strap extending across the bottom of the bootie and through side slots, the ends of the guide strap containing fasteners for mating engagement with fasteners on the interior of the inner liner.

3. The boot of claim 1 wherein the lower shell has a heel with a skewed rear wall which joins the bottom wall of the heel at an obtuse angle.

4. A boot comprising:

a lower shell for containing a wearer's foot, an upper shell assembly having overlapping edge regions and entry means for separating the overlapping edge regions to allow entry of a wearer's foot, one of the edge regions having exterior elements and interior elements alternately spaced along the edge region, the other of the edge regions having interior elements and exterior elements alternately spaced along the edge region, the exterior elements overlying the interior elements on the opposite edge regions to form an interleaved pattern of overlying elements from alternate edge regions in order to seal the upper shell assembly, and connector means for interconnecting the upper shell assembly to the lower shell for pivoting movement therebetween.

5. The boot of claim 4 wherein the exterior elements on the one edge region comprises flexible straps which externally wrap around a portion of the upper shell assembly, and the entry means includes a first closure device secured to the straps for releasably engaging a second closure device secured to the upper shell assembly to latchably close the upper shell assembly.

6. The boot of claim 5 wherein the interior elements of the one edge region comprise recessed webs located between the straps, and the exterior elements on the other edge region comprise flaps which override the recessed webs to form a generally flush surface with the straps.

7. A boot comprising:

a lower shell for containing a wearer's foot, an upper shell assembly having an arcuate door and an arcuate cuff, hinges for interconnecting one side of the arcuate door to the arcuate cuff, the opposite side of the arcuate door having exterior elements and interior elements alternately spaced along the edge region thereof, the arcuate cuff having interior elements and exterior elements alternately spaced along the edge region thereof, the exterior elements overlying the interior elements on the opposite edge regions to form an interleaved pattern of overlying elements from the door and the cuff in order to seal the upper shell assembly, and connector means for interconnecting the upper shell assembly to the lower shell for pivoting movement therebetween.

8. The boot of claim 7 wherein the arcuate door has alternate raised portions and recessed portions, the raised portions extending only partially across the door and having a U-shaped cut-out to form overhanging flaps which correspond to the exterior elements and slidably overlie webs in the arcuate cuff which correspond to the interior elements.

9. The boot of claim 8 wherein the lower shell has a front tongue and rear flap means deflectable by the upper shell assembly as it is moved forward and rearward, the front tongue and the rear flap means generally closing the region between the lower shell and the upper shell assembly to prevent penetration by external objects.

10. The boot of claim 9 including an inner liner extending through the upper shell assembly, and a wear strip substantially harder than the inner liner and secured to the front thereof for slidably engaging the tongue as deflected by the upper shell assembly.

11. The boot of claim 4 wherein the connector means includes a plate having an elongated slot and attached to one of the lower shell or the upper shell assembly, a pivot pin having a head larger than the slot and a reduced neck extending through the slot and of a diameter less than the width of the slot and substantially less than the length of the slot, and means securing the pivot pin to the other of the lower shell or upper shell assembly for producing forward and rearward pivotal motion, rocking sideways motion, and twisting motion of the upper shell relative to the lower shell.

12. A boot comprising:

an upper shell, a lower vamp shell having a bottom recess extending across a portion thereof, connector means interconnecting the upper shell to the vamp shell for movement therebetween, a replaceable sole insert having a shape corresponding to the bottom recess and formed at least partly of a relatively resilient material with respect to the material of the vamp shell, and mechanical lock means for releasably securing the replaceable sole insert within the bottom recess.

13. The boot of claim 12 wherein the mechanical lock means includes an undercut edge wall in the bottom recess, and the replaceable sole insert includes a skewed edge which mates with the undercut edge wall to hold the skewed edge within the bottom recess.

14. The boot of claim 13 wherein the mechanical lock means further includes a fastener insertable through the replaceable sole insert and into the vamp shell, the fastener being spaced from the undercut edge wall to hold the replaceable sole insert therebetween.

15. The boot of claim 12 wherein the bottom recess extends across the entire width of the vamp shell in one region and extends only partly across the width of the vamp shell in another region, and the replaceable sole insert has a width corresponding to the width of one region with an extension less than the width of the vamp shell and mating with other regions.

16. The boot of claim 12 wherein the replaceable sole insert includes a protective plate having a shape generally corresponding to the bottom recess, and a relatively resilient material covering the protective plate to form a gripping surface.

17. The boot of claim 16 wherein the protective plate is perforated with a plurality of apertures extending therethrough, and the resilient material is molded to the bottom of the protective plate and extends through the plurality of apertures to permanently secure the gripping material to the protective plate.

18. The boot of claim 16 wherein the protective plate includes at least one enlarged aperture extending therethrough, and the relatively resilient material extends from the bottom of the sole insert through the enlarged aperture to transmit external forces through the protective plate to the bottom of the foot area of the vamp shell.

19. The boot of claim 12 wherein the vamp shell includes a top surface containing a plurality of upright ridges extending above the surface of the vamp shell to form a gripping area.

20. A replaceable sole insert for attachment to the sole portion of a boot, comprising:

a protective carrier plate of relatively rigid material to form a support and protector, and a resilient pad secured to at least the exterior of the carrier plate and formed of a gripping material which is relatively resilient with respect to the relatively rigid material of the carrier plate.

21. The replaceable sole insert of claim 20 wherein the carrier plate is perforated with a plurality of apertures extending therethrough, and the gripping material is molded to the perforated carrier plate and extends through the plurality of apertures.

22. The replaceable sole insert of claim 21 wherein the perforated carrier plate includes at least one opening substantially larger than the plurality of apertures, and the gripping material extends through the opening to transmit forces applied against the bottom of the resilient pad through the protective plate to the sole portion of the boot.

23. The replaceable sole insert of claim 20 wherein the carrier plate is formed by a U-shaped channel having side flanges, and the gripping material is secured to the bottom of the carrier plate and contiguously aroung the side flanges.

24. The replaceable sole insert of claim 20 wherein the carrier plate has an edge extending at least partially across the sole portion of the boot, and the gripping material has a terminating wall at a skew to the edge to mechanically lock the sole insert within an undercut recess in the sole portion of the boot.

25. A boot comprising:

an upper shell, a lower vamp shell for containing a wearer's foot including a top surface above the toe area of the wearer's foot and having a plurality of upright ridges extending above the surface of the vamp shell to form a gripping area with the upright ridges having an increasing height nearer the front of the lower vamp shell to provide an upward slope to the gripping area, and connector means interconnecting the upper shell to the vamp shell.

26. The boot of claim 25 wherein the lower vamp shell is formed of plastic and the plurality of upright ridges are molded as an integral part of the lower vamp shell.

27. A boot comprising:

a lower shell having a foot opening with a tongue flexibly connected to the front thereof, recessed surface means connected to the foot opening adjacent the tongue to underlie the tongue and seal the space between the tongue and the front portion of the foot opening when the tongue is moved rearwardly, a generally cylindrical upper shell for containing a wearer's leg and movable rearwardly to deflect the tongue into a position overlying the recessed surface means to prevent penetration by external objects, a connector plate having an opening larger than the neck of a pivot pin, means securing the connector plate to one of the upper or lower shells and the pivot pin to the other of the upper or lower shells to provide forward and rearward pivotal motion and rocking sideways motion of the upper shell relative to the lower shell.

28. The boot of claim 27 wherein the upper shell includes an arcuate front door and an arcuate rear cuff, side hinges connecting the front door to the rear cuff for opening the cylindrical shell to allow entry of a wearer's foot and leg, and closure means for releasably securing the front door closed against the rear cuff.

29. The boot of claim 28 wherein the side hinges are formed by flexible hinge leaves integral with the rear cuff and extending forwardly therefrom, and fasteners for attaching the flexible hinge leaves to the sides of the front door.

30. The boot of claim 28 including at least one flexible spring latch extending from the rear cuff and deflectable by the front door into a position which latches open the front door.

31. A boot comprising:

an upper shell assembly including an arcuate door forming a portion of a generally cylindrical shell and an arcuate cuff forming the remaining portion of the generally cylindrical shell, door hinge means interconnecting an edge region of the arcuate door to an edge region of the arcuate cuff for opening and closing the arcuate door to allow entry of a wearer's foot and leg, the opposite edge region of the arcuate cuff including a plurality of elongated flexible straps which externally wrap around the arcuate door to close the door against the cuff, a first closure member secured to the plurality of straps for releasably engaging a second closure member secured to the arcuate cuff to latchably close the plurality of flexible straps, the arcuate door having a plurality of recessed lands of a depth approximately equal to the thickness of the flexible straps, and the lands being located to receive the flexible straps therein so that the external surface of the generally cylindrical shell is flush in the vicinity of the arcuate door, a lower shell having a foot receiving opening with a front tongue flexibly connected to the front of the foot receiving opening and rear flap means connectable to the rear of the foot receiving opening, shell hinge means for lost motion connection of the upper shell assembly to the lower shell to allow forward and rearward pivotal motion and rocking sideways motion of the upper shell relative to the lower shell with the sides of the upper shell assembly extending downwardly further than the front and rear of the upper shell assembly with the sides being interconnected to the hinge means, the upper shell assembly deflecting the front tongue and rear flap means as the upper shell assembly is moved in order to close the region between the lower shell and the upper shell assembly to prevent penetration by external objects, and a waterproof inner liner of generally cylindrical configuration having a bottom region hermetically sealed to the lower shell and extending through the upper shell assembly for containing the wearer's foot and leg.

32. The boot of claim 31 wherein the arcuate door is located at the front of the upper shell assembly, the door hinge means are located on the outboard side of the upper shell assembly, and means located on the inboard side of the upper shell assembly for sealing the arcuate door against dirt and mud.

* * * * *